US005704289A

United States Patent [19]

Bolza-Schünemann et al.

[11] Patent Number: 5,704,289

[45] Date of Patent: *Jan. 6, 1998

[54] FLEXIBLE BEVELED EDGE PLATE FASTENING DEVICE

[75] Inventors: Hans-Bernhard Bolza-Schünemann; Claus August Bolza-Schünemann, both of Würzburg; Christian Martin Michael Fischer, Marktheidenfeld; Willi Albert Peter Kutzner, Würzburg, all of Germany

[73] Assignee: Koenig & Bauer-Albert Aktiengesellschaft, Wurzburg, Germany

[ * ] Notice: The term of this patent shall not extend beyond the expiration date of Pat. No. 5,551,340.

[21] Appl. No.: 510,057

[22] Filed: Aug. 1, 1995

[30] Foreign Application Priority Data

Aug. 6, 1994 [DE] Germany ..... 44 27 944.2

[51] Int. Cl.[6] ..... B41F 1/28

[52] U.S. Cl. ..... 101/415.1; 101/382.1; 101/395

[58] Field of Search ..... 101/415.1, 409, 101/395, 382.1, 381, 380

[56] References Cited

U.S. PATENT DOCUMENTS

| | | | |
|---|---|---|---|
| 2,668,498 | 2/1954 | Boyajean, Jr. | 101/415.1 |
| 2,935,937 | 5/1960 | Rossetto et al. | 101/409 |
| 2,965,025 | 12/1960 | Mueller | 101/415.1 |
| 3,195,458 | 7/1965 | Nystrand | 101/415.1 |
| 3,217,644 | 11/1965 | Schmidt | 101/415.1 |
| 3,536,003 | 10/1970 | Oderman | 101/415.1 |
| 4,557,196 | 12/1985 | Kobler | 101/415.1 |

FOREIGN PATENT DOCUMENTS

| | | | |
|---|---|---|---|
| 0 193 144 | 9/1986 | European Pat. Off. . | |
| 1 960 635 | 8/1972 | Germany . | |
| 34 34 642 | 6/1986 | Germany . | |
| 39 18 977 | 12/1990 | Germany . | |
| 3918977 | 12/1990 | Germany | 101/415.1 |
| 40 35 664 | 6/1991 | Germany . | |
| 40 36 387 | 5/1992 | Germany . | |
| 40 36 388 | 5/1992 | Germany . | |
| 40 36 389 | 5/1992 | Germany . | |
| 40 36 390 | 5/1992 | Germany . | |
| 40 36 391 | 5/1992 | Germany . | |
| 35 43 704 | 6/1993 | Germany . | |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

A flexible plate is securable to a cylinder by insertion of fastening tabs, provided on beveled or angled ends of the plate, into cooperatively shaped end positioned pockets on the cylinder surface. The pockets may be formed by insert strips that utilize spaced tines to define the individual pockets.

10 Claims, 2 Drawing Sheets

FLEXIBLE BEVELED EDGE PLATE FASTENING DEVICE

FIELD OF THE INVENTION

The present invention is directed generally to a flexible, beveled edge plate fastening device. More specifically, the present invention is directed to a device for fastening flexible plates with beveled edges on a cylinder of a rotary printing press. Most particularly, the present invention is directed to a device for fastening flexible plates with beveled edges on a cylinder having slit inlets or pockets in a rotary printing press. The flexible plate is provided with a plurality of spaced fastening brackets or tabs on its beveled edges or ends. The cylinder has an insert groove which forms the pockets that are separated by tines. The cylinder pockets receive the brackets or tabs thus fastening the plate to the cylinder.

DESCRIPTION OF THE PRIOR ART

The use of flexible plates, such as printing plates and flexible blankets with beveled edges on cylinders in rotary printing presses is generally known in the art. German Patent Publication DE PS 1960635 and DE 40 35 664 A1 both show devices that are usable for fastening such flexible plates with beveled edges or ends on a plate cylinder of a rotary printing press. In these prior art devices, the surface area of the plate cylinder is provided with one, or a plurality of axially extending slits that receive the beveled edges or ends of the plate. These slits are each structured to be axially continuous on the plate cylinder.

A limitation of these prior art flexible plate end fastening arrangements is that an axially extending gap is created at the plate ends. This gap prevents the continuous engagement of the flexible plate cylinder with a cooperating cylinder. The surface of the flexible plate cylinder has an axially extending discontinuity in the area of the axially extending gap. This surface discontinuity prevents the even and smooth cooperation of this plate cylinder with cooperating cylinders. Vibrations are apt to be incurred in the rotary printing press as a result of these axially extending discontinuities. These vibrations can have serious consequences and will produce printing results that are not acceptable.

In German Patent Publication 34 34 642 C2 there is shown a joint free printing plate and rubber blanket clamping device that is usable on cylinders of a rotary printing press. In this prior art device, the cylinder is provided with a non-continuous cylinder trough and with strips disposed in clamping brackets. The length of the strips is only a small fraction of the length of the cylinder trough. A limitation of this arrangement is that the short strips are not suited to absorbing the large forces of dynamic joint stresses. Furthermore, the specific stress of the strips or of a material placed in the cylinders is quite large. These large stresses may result in failure of the clamping device.

In another prior art arrangement, as shown in German Patent Publication 35 43 704 C2 it is known to attach sheaths or so-called "sleeves", which are closed in the circumferential direction on the cylinder. These sleeves or sheaths are mounted on the cylinder instead of the flexible plates or blankets as previously discussed. These sleeves or sheaths provide a continuous functional connection or contact between cylinders and thus avoid the joint stresses that occur in cylinders with discontinuous surfaces.

It is very difficult to attach these sheaths or sleeves on the surface of a cylinder. Various patents, such as German Patent Publication Nos. DE 40 36 387 A1; DE 40 36 388 A1; DE 40 36 389 A1; DE 40 36 390 A1; and DE 40 36 391 A1 are all directed to arrangements that have been utilized to mount these continuous sleeves or sheaths on a cylinder.

An additional limitation of these sleeves is that the sleeve or sheath must be changed as a complete unit. This means that all of the individual printing formes which are on the sleeve will be removed as a unit. However, it is often the case where a cylinder is covered with a plurality of individual printing plates or formes. This is particularly true in the printing of newspapers. It may be the situation that only one of these individual plates is to be changed. These prior art one piece sleeves or sheaths cannot accomplish this result. Additionally, these cylindrical sleeves or sheaths require a very large amount of storage space as compared to conventional, flat-lying plates.

It will be seen that a need exists for a device that will accomplish the attachment of flexible plates with beveled edges or ends to a cylinder of a rotary printing press which overcomes the limitations of the prior art devices. The flexible beveled edge plate fastening device in accordance with the present invention provides such a device and is a significant improvement over the prior art devices.

SUMMARY OF THE INVENTION

It is an object of the present invention to provide a flexible beveled edge plate fastening device.

Another object of the present invention is to provide a device for fastening flexible plates with beveled edges on a cylinder of a rotary printing press.

A further object of the present invention is to provide a device for fastening flexible plates with beveled edges on a cylinder having slit inlets on a rotary printing press.

Yet another object of the present invention is to provide a device for fastening flexible plates with beveled edges having comb-like plate ends.

Still a further object of the present invention is to provide a flexible plate end fastening device in a cylinder having a plurality of axially spaced pockets.

As will be discussed in greater detail in the description of the preferred embodiment which is presented subsequently, the flexible beveled edge plate fastening device in accordance with the present invention utilizes an insert strip, which is placed in an axially extending cylinder groove, and which is provided with a plurality of axially spaced tines, to define a plurality of pockets on the cylinder. The flexible plate to be secured to the surface of this cylinder has a plurality of fastening brackets or tabs along its two beveled ends, one at the print start and the other at the print end of the plate, if the plate is a printing forme. These fastening brackets or tabs are sized to be received on the cooperatively shaped pockets on the cylinder surface.

The flexible, beveled edge plate fastening device in accordance with the present invention provides a fastening arrangement which causes much less vibration than the prior art arrangements. The pockets on the cylinder are spaced apart and create only partial surface disruptions instead of the larger discontinuity created by the prior art devices. When viewed in the circumferential direction of the cylinder, only portions of the circumference are disrupted by the pockets. This leaves areas of the circumference that are continuous. This structure provides areas for supporting the plate at its ends while at the same time providing a structure which accomplishes the fastening of the plate ends to the cylinder in a simple, easy manner. This is due to the arrangement of the spaced pockets in the insert strip. This arrangement of spaced pockets prevents the joint stresses and vibrations, which are present in the prior art devices that utilize an axially extending strip, to the greatest extent possible. The minimization of these joint stresses and vibrations provides the best printed image possible.

Several individual plates, such as printing plates, can be secured to the surface of the cylinder and can be individually removed from the cylinder. This allows individual plates to be removed and replaced without disrupting other plates on the cylinder. Generally well known and conventional printing plate supports and conveying installations, as have been previously utilized with flexible flat plates, can be used with the present invention. The beveled ends of the plates in accordance with the present invention have a generally similar overall profile to prior beveled end plates. Thus existing plate handling equipment can still be used with the plates of the present invention.

In addition, since the pockets are formed in the surface of the cylinder by the use of specially shaped insert strips, prior cylinders that are provided with insert strips can be retrofitted by installation of the insert strips in accordance with the present invention.

The insert strip in the cylinder precisely defines the location of the pockets in the cylinder. The axial position of the flexible plate or plates on the cylinder can be accurately determined because of the structure of the pockets and the fastening tabs or brackets. This allows for the omission of additional lateral register adjustment devices that have been required in the prior art devices. The proper dimensioning of the fastening tabs and the cooperating insert pockets insures that the plates will be located on the cylinder in a fixed position and will not be able to shift axially. Lateral register adjusting devices, such as register pins, which have been necessary to accomplish the proper lateral positioning of the plates, can be omitted in the present device.

The flexible beveled end plate fastening device in accordance with the present invention overcomes the limitations of the prior art devices. It is a substantial advance in the art.

BRIEF DESCRIPTION OF THE DRAWINGS

While the novel features of the flexible beveled end plate fastening device in accordance with the present invention will be set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 2:
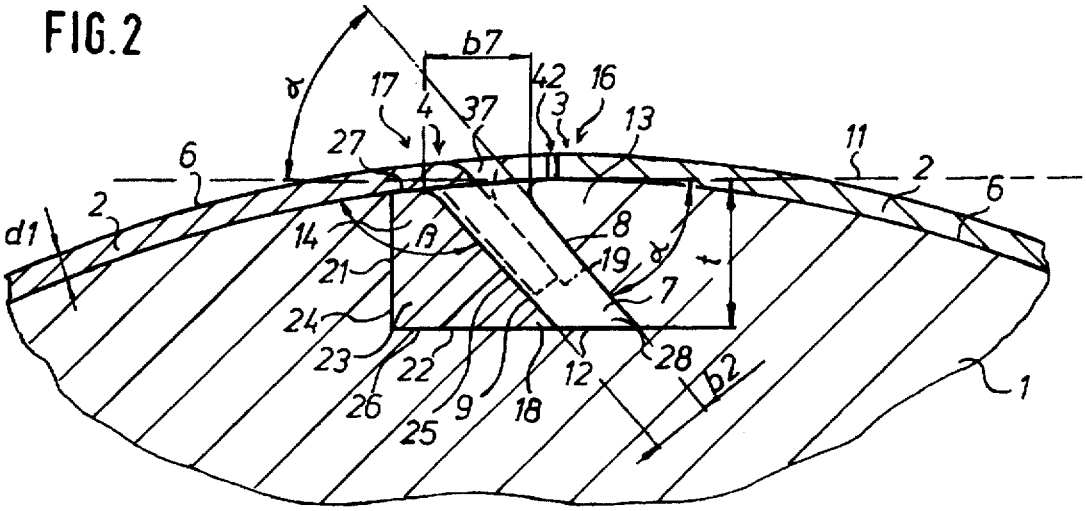
FIG. 2 is a schematic cross-sectional view of the cylinder with a plate attached as taken along line II—II of FIG. 1.
Figure 3:
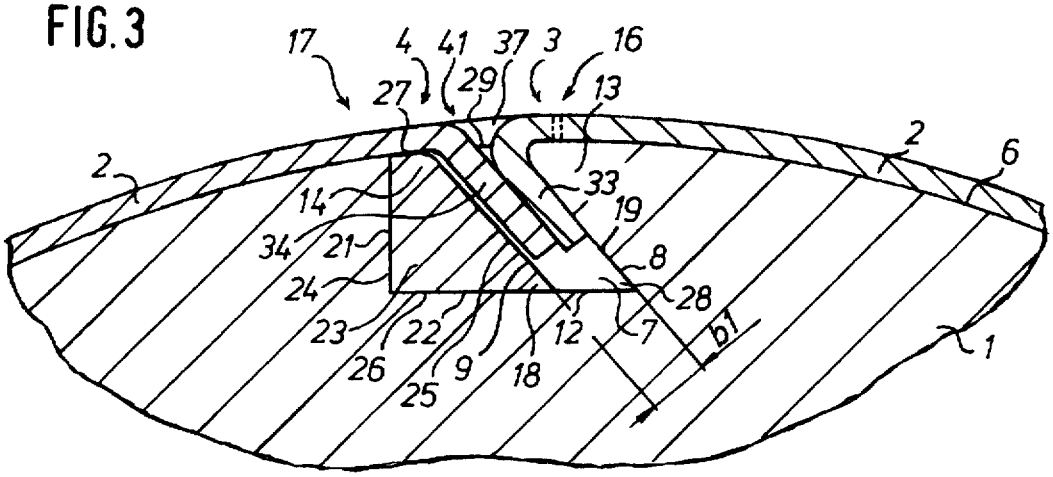
FIG. 3 is a schematic cross-sectional view of the cylinder with a plate attached and taken along line III—III of FIG. 1.
Figure 1:
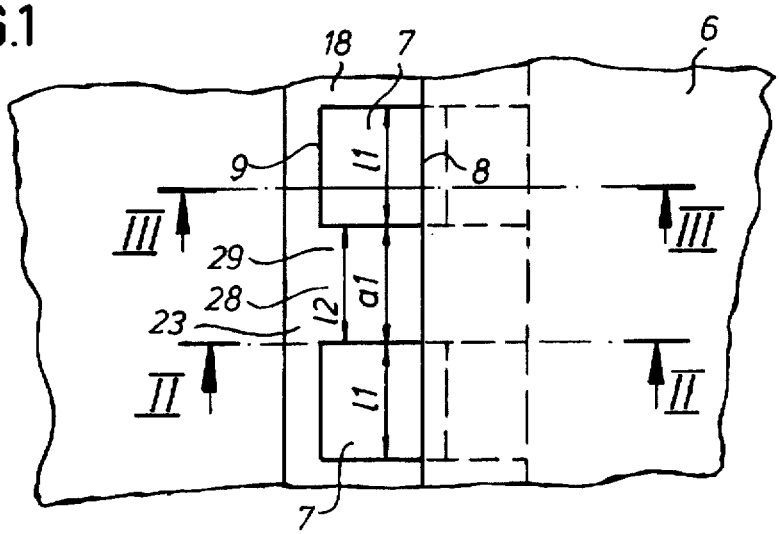
FIG. 1 is a top plan view of a portion of a cylinder, with its plates removed, and showing the pockets in accordance with the present invention.

Referring initially to FIGS. 1, 2 and 3 there may be seen, generally at 1, a cylinder of a rotary printing plate. It will be understood that cylinder 1 is supported for rotation between spaced side frames, not shown, of the rotary printing press and will be driven in a generally well known manner.

Figure 4:
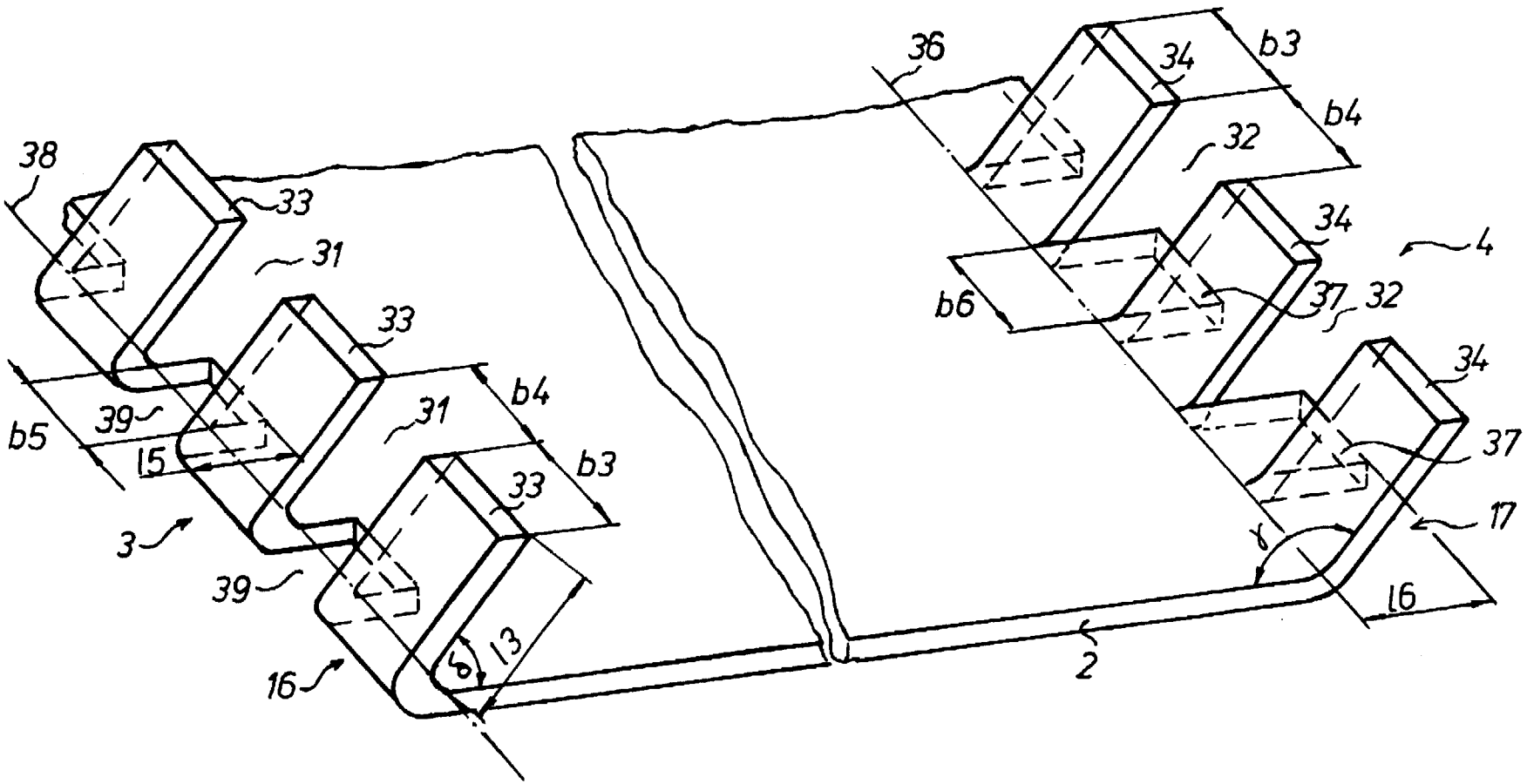
FIG. 4 is a perspective view of a flexible, beveled end plate in accordance with the present invention.

A flexible plate, generally at 2, which is securable to the cylinder 1, is shown most clearly in FIG. 4. Flexible plate 2 has beveled ends 3 and 4 with these ends 3 and 4 being beveled or angled so as to be directed generally radially inwardly when plate 2 is secured on cylinder 1, as may be seen in FIGS. 2 and 3. The flexible plate 2 is depicted in FIG. 4 on its back; i.e. with its typically outwardly facing surface down. The plate 2 has a thickness d1 of, for example, 0.3 mm and is preferably a printing plate. The plate 2 could also be a flexible rubber coated blanket plate or another type of flexible plate.

The cylinder 1 is provided with a plurality of axially spaced slit shaped inserts, such as slit-shaped pockets 7 which extend generally inwardly from an outer circumferential surface 6 of the cylinder 1 into the interior of the cylinder 1. These pockets 7 each have an axial pocket length 11 of, for example 60 mm, and are spaced axially from each other at a pocket spacing distance a1 of, for example 60 mm.

The several pockets 7 located on the peripheral surface 6 of the cylinder 1 are all positioned along a straight, axially extending line that is parallel to the axis of rotation of the plate cylinder 1. As may be seen in FIG. 2, each pocket 7 is defined by first and second spaced, parallel lateral surfaces 8 and 9. These two lateral surfaces 8 and 9 are inclined at an angle of inclination $\alpha$ with respect to a tangent line 11 which contacts the surface 6 of the cylinder 1 in the area of the pockets 7. These two lateral pocket surfaces 8 and 9 are spaced from each other at a distance b1. Each pocket is further defined by a pocket base 12 that is situated at a distance t of, for example, 25 mm, beneath the surface 6 of the cylinder 1, as measured from the tangent line 11. The base 12 is parallel to the tangent line 11, as shown in FIGS. 2 and 3. The width b1 of each of the pockets 7 may be 1.5 mm. The inclination angle $\alpha$ may be between 30° and 90° and is preferably about 45°. The right lateral pocket wall surface 8; together with the surface 6 of the cylinder 1 form an acute angle nesting tab or hook having an opening angle $\alpha$ of approximately 45°The left lateral wall surface 9 of pocket 7, together with the surface 6 of the cylinder 1 form an obtuse angled nesting tab or hook 14 which has an opening angle $\beta$ of approximately 135°. The acute-angled nesting hook 13 is preferably disposed on a print start 16 of plate 2. If there is only a single row of pockets 7 for the receipt of both the beveled ends 3 and 4 of a plate 2 it will be apparent that the pocket width b1 must be at least twice the thickness d1 of the plate 2. It would be possible to apply several plates 2 in the circumferential direction around the surface 6 of the plate cylinder 1. In such an arrangement, the several rows of pockets, such as two such rows of pockets 7 would be circumferentially spaced from each other at 180° on the surface 6 of the plate cylinder 1. Each row of pockets 7 can extend over the entire width of the surface area 6 of the cylinder 1. Alternatively, several rows of pockets 7 can be provided over the width of the surface area 6 of the cylinder 1. The number of rows of pockets 7 and their placement on the surface 6 of the cylinder 1 will be a function of the number and arrangement of the plates 2 that are intended to be attached to the cylinder 1.

Instead of the use of a single row of pockets 7 which are used to receive both ends 3 and 4 of a plate 2 at the print start 16 and the print end 17 of the plate 2, the cylinder 1 could be provided with two separate rows of pockets 7 placed circumferentially adjacent each other and spaced by a distance of, for example about 5 mm. In this arrangement, the nesting hooks 13 formed by a first row of pockets 7 are preferably acute-angled while the nesting hooks formed by the second row of pockets 7 are preferably obtuse-angled. In this type of arrangement, the width b1 of each of the pockets 7 will be only slightly larger, for example 0.5 mm, than the thickness d1 of the plate 2.

Again referring primarily to FIGS. 1–3, in the present invention, the cylinder 1 has been provided with axially extending trough or groove 18 at its surface 6. This groove 18 is defined by a first lateral wall surface 19 that has the angle of inclination α of the pockets 7, a second lateral surface 21 which extends generally radially and is generally perpendicular to the tangent line 11, and a base 22 which is generally parallel to the tangent line 11. An insertion or insert strip 23 is secured by suitable means (not shown) in this groove or trough 18. This insert strip 23 may be seen in FIGS. 2 and 3 as having a left lateral surface 23 which engages the lateral groove surface 21 and a base 26 which engages the groove base 22. The insert strip 23 also has an exterior surface 27 whose contour is adapted to match the contour of the cylinder peripheral surface 6. The second lateral surface 9 of the pocket 7 is formed by a lateral surface 25 of the insert strip 23. This means, as may be seen in FIG. 2, that the left lateral surface 9 of the pocket 7 is formed by the right lateral surface 25 of the insert strip 23. If desired, the insert strip 23 can be shifted axially along the groove 18 in the cylinder 1.

As may be seen most clearly in FIG. 1 the insert strip 23 is structured with its right lateral surface 25 provided with a plurality of tines 28. Each of these tines has a thickness b2 of preferably 1.5 mm and each tine has an axial length l2 of 60 mm. These tines are disposed at regular intervals and are spaced from each other by the spacing distance or pocket width l1. The thickness b2 of each tine 28 and the length l2 of each tine 28 in this arrangement correspond to the width b1 and the spacing distance a1 of the pockets 7 so that the cylinder groove 18 is completely bridged or closed in the areas of the insert strip 23 that are provided with the tines 28. Each tine 28 also has an exterior surface portion 29 that is adapted to conform to the contour 6 of the cylinder 1. These tine exterior surfaces 29 thus continue the contour of the surface 6 of the cylinder 1 essentially without any interruption. The placement of the insert strip 23 in the cylinder groove 18 thus renders the groove 18 effectively discontinuous in the axial direction. Instead, the cylinder surface 6 is provided with the spaced pockets 7 of a width b1 and a length l1 spaced at a distance a1 from each other. These pockets 7 are separated by the exterior surfaces 29 of the tines 28. The pockets 7 each have a width of b1 as was discussed previously. However, due to the angle of inclination α of these pockets 7 with respect to the surface 6 of the plate cylinder 1, these pockets have a surface opening width b7 which must be bridged by the plate beveled ends 3 and 4 for the cylinder 1 to be able to roll off a cooperating cylinder in a smooth, vibration-free manner.

Turning now to FIG. 4, it may be seen that each flexible plate 2 has its beveled ends 3 and 4 provided with a plurality of recesses or gaps 31 and 32, respectively. Each such recess or gap 31 or 32 has a width b4 of, for example 60 mm across the width of the plate 2. The beveled ends 3 and 4 are thus formed with a plurality of fastening brackets or tabs 33 and 34 each of which has a length l3 of, for example 20 mm and a width b3 of, for example 60 mm. These fastening brackets or tabs 33 and 34 are spaced by the intervening recesses or gaps 31 and 32, respectively. The fastening brackets or tabs 33 at the print start 16 of the plate 2 form an angle δ of, for example 45° with the planar surface of the plate 2. The fastening brackets or tabs 34 at the print end 17 of the plate 2 form an angle τ of, for example 135° with the planar surface of the plate 2. The angle δ at the print start 16 is preferably an acute angle while the angle τ at the print end 17 is preferably an obtuse angle.

As may also be seen most clearly in FIG. 4, the planar surface of the plate 2 extends beyond a bending line 36 at the print end 17 in the area of the recesses or gaps 32. These plate extensions form a plurality of planar tongues 37 each having a width b6 and a length l6. The width b6 is preferably the same as the recess or gap width b4. These tongues 37 are positioned interposed between the obtusely angled fastening brackets or tabs 34 at the plate print end 17. On the opposite end of the plate 2; i.e. the plate print start 16, the recesses or gaps 31 are formed as plate cut-outs 39 that are cut into the planar portion of the plate 2 and extend into the plate 2 beyond a bending line 38 for the acutely angled print start fastening brackets or tabs 33. These plate cut-outs 39 each have a width b5 and a depth 15. The plate cut-outs 39 and the plate tongues 38 are disposed at the opposing longitudinal ends of the plate 2 with the tongues 37 preferably disposed at the plate print end 17. The width b5 of each of the plate cut-outs 39 is at least as great as the width of the correspondingly situated plate tongue 37. The length 16 of each of the tongues 37 is at least long enough so that the width b7 of, for example 3 mm, which results on the surface area 6 of the cylinder 1, because of the width b2 of the inclined pockets 7 is assured to be bridged. This width b7 may be seen most clearly in FIG. 2. It will be understood that it is within the scope of the present invention to provide two rows of pockets 7 on the surface 6 of the cylinder 2. One row of pockets 7 will receive the beveled ends 3 of a plate print start 16 while the other row of pockets will receive the beveled end 4 of a plate print end 17. In such an arrangement, the tongues 37 as well as the cut-outs 39 can also be beveled.

Referring now again to FIGS. 1–3, when a flexible plate 2 is applied to the surface 6 of a cylinder 1, the fastening brackets or tabs 33 and 34 at the plate print start 16 and the plate print end 17, respectively are simultaneously inserted into the pockets 7 which extend axially across the surface 6 of the cylinder 1. This placement positions the tongues 37 at the plate print end 17 in their cooperatively shaped cut-outs 39 at the plate print start 16, as may be seen in FIGS. 1–3. In this arrangement, the tongues 37 on the beveled end 4 of the plate 2 are received in the cut-outs 39 on the opposing plate end 3 in an interlaced manner.

When the flexible plate 2 is applied to the cylinder 1, the fastening brackets or tabs 33 and 34 at the print start 16 and print end 17 portions of the plate 2 lie close to each other in the pockets 7. They form axially interrupted first joints 41. These first or tab joints 41 are spaced between the interlaced tongues 37 which act as bridges that are axially spaced between the joints 41. The provision of these bridges formed by the tongues 37 prevents the axially interrupted joints 41 from having any damaging effect on print quality, as would be the case if these tab joints 41 were not axially interrupted. Second or tongue joints 42 are formed where the ends of the tongues 37 are received in their cooperating cut-outs 39. These second or tongue joints 42 are axially interrupted across the width of the cylinder 1 and are circumferentially non-aligned with the first or tab joints 41. These second or tongue joints 42 are bridged by the fastening brackets or tabs 33 which are located axially between each two such tongue joint 42. The result is that the surface area 6 of the cylinder 1 does not have a joint line which extends axially across the width of the cylinder. Instead, there are provided circumferentially staggered, axially discontinuous joint segments 41 and 42 which insure that at any time a portion of the flexible plate 2 is in contact with its opposing cylinder so that there is no axially continuous joint line into which the opposing cylinder can fall.

In the preferred embodiment of the flexible plate fastening device in accordance with the present invention, the ratio of the sum of the widths b6 of the tongues 37 to the sum of the widths b3 of all of the fastening brackets or tabs 33 and 34 is between 0.5 to 1 and 1.5 to 1. Preferably, the width ratios are 1 to 1. This means that the continuous support portion of the plate 2 in the areas of the joints 41 and 42 is preferably 50%. Thus at any time, 50% of the axially extending surface 6 of the cylinder 1 is in contact with its cooperating cylinder.

In accordance with the present invention, it is possible that the fastening brackets or tabs 33 and 34 of the plate 2 can cooperate with clamping or tensioning devices that are situated beneath the pockets 7 or adjacent the pockets 7. This will insure that the fastening brackets 33 and 34 will be fixed in place in the interior of the cylinder 1. It is also within the scope of the present invention that at least one of the fastening brackets or tabs 33 can cooperate with at least one side surface of one of the pockets 7 to form a lateral register stop for the flexible plate 2 on the surface 6 of the cylinder 1.

While a preferred embodiment of a flexible plate end fastening device in accordance with the present invention has been set forth fully and completely hereinabove, it will be apparent to one of skill in the art that a number of changes in, for example, the overall size of the plate, the drive assembly for the cylinder, the material used for the plate and the like could be made without departing from the true spirit and scope of the present invention which is accordingly to be limited only by the following claims.

What is claimed is:

1. A flexible, beveled end plate fastening device comprising:

a cylinder of a rotary printing press;

a plurality of axially spaced pockets formed on a surface portion of said cylinder said pockets, extending into an interior of said cylinder, each of said pockets having an axial pocket length and a circumferential width, each of said pockets being separated from adjacent pockets by said surface portion of said cylinder at an axial pocket spacing distance;

a flexible plate body; and a plurality of axially spaced fastening tabs formed at first and second longitudinal ends of said flexible plate body, each of said fastening tabs being formed at an angle with respect to said plate body and being receivable in a cooperating one of said pockets to fasten said flexible plate on said cylinder, each of said tabs being separated from adjacent tabs by a tab spacing distance, said tab spacing distance being the same as said axial pocket spacing distance.

2. The device of claim 1 wherein said flexible plate body has a plate thickness and further wherein said width of each of said pockets is greater than said plate thickness.

3. The device of claim 1 wherein said flexible plate body has a plate thickness and further wherein said width of each of said pockets is greater than twice said plate thickness.

4. The device of claim 1 wherein said pockets are inclined in said cylinder at an inclination angle, with respect to a tangent line at said surface of said cylinder, of between 30° and 90°.

5. The device of claim 1 wherein a ratio of a sum of said axial lengths of said pockets to an axial width of said cylinder is between 0.5 and 1 to 1.

6. The fastening device of claim 3 wherein each said pocket receives a fastening tab on said first end of one of said plate and a lateral fastening tab on said second end of one of said plates, said pockets being arranged along a single axially extending line.

7. The device of claim 2 wherein said fastening tabs on said first end of said plate are received in a first axially extending line of said pockets and said fastening tabs on said second end of said plate are received in a second axially extending line of said pockets, said first and said second lines of pockets being parallel.

8. The device of claim 1 wherein each of said pockets further includes lateral walls, at least one of said lateral walls acting as a lateral register stop for said plate.

9. The device of claim 1 further including a cylinder groove in said cylinder and an insert strip having spaced tines positioned in said cylinder groove, said insert strip cooperating with said cylinder groove to form said plurality of axially spaced pockets, each of said tines having an exterior surface conforming to said surface of said cylinder.

10. A flexible beveled end plate fastening device comprising:

a cylinder of a rotary printing press;

a plurality of axially spaced pockets formed on a surface portion of said cylinder, said pockets extending into an interior of said cylinder, each of said pockets having an axial length and a circumferential width;

a flexible plate body;

a plurality of axially spaced fastening tabs formed at first and second longitudinal ends of said flexible plate body, each of said fastening tabs being formed at an angle with respect to said plate body and being receivable in a cooperating one of said pockets to fasten said flexible plate body on said cylinder;

a plurality of spaced tongues on said first end of said plate body, each of said tongues being interposed between two of said first end fastening tabs, said tongues extending out from said plate body; and a plurality of spaced cut-outs on said second end of said plate body, each of said cut-outs being interposed between two of said second end fastening tabs, said cut-outs extending into said plate body and being sized to receive one of said tongues.

* * * * *

UNITED STATES PATENT AND TRADEMARK OFFICE
CERTIFICATE OF CORRECTION

PATENT NO. : 5,704,289

DATED : January 6, 1998

INVENTOR(S) : Bolza-Schunemann et al.

It is certified that error appears in the above-identified patent and that said Letters Patent is hereby corrected as shown below:

Column 8, claim 6, line 3, before "and" change "plate" to --plates--, and after "a" delete "lateral".

Signed and Sealed this

Seventh Day of April, 1998

Bruce Lehman

*Attest:*

BRUCE LEHMAN

*Attesting Officer*

*Commissioner of Patents and Trademarks*